US005460665A

United States Patent [19]

Yasuhara et al.

[11] Patent Number: 5,460,665

[45] Date of Patent: Oct. 24, 1995

[54] METHOD OF MANUFACTURING A LOW-ALLOY ULTRA-LOW-CARBON COLD ANISOTROPY ROLLED STEEL SHEET EXHIBITING AN EXCELLENT RESISTANCE TO FABRICATION EMBRITTLEMENT AND SMALL INTERNAL ANISOTROPY

[75] Inventors: Eiko Yasuhara; Kei Sakata; Susumu Satoh; Toshiyuki Kato, all of Chiba, Japan

[73] Assignee: Kawasaki Steel Corporation, Tokyo, Japan

[21] Appl. No.: 321,583

[22] Filed: Oct. 11, 1994

Related U.S. Application Data

[63] Continuation-in-part of Ser. No. 164,612, Dec. 8, 1993, abandoned, which is a continuation of Ser. No. 966,871, Oct. 26, 1992, abandoned.

[30] Foreign Application Priority Data

Oct. 29, 1991 [JP] Japan ..... 3-282978

[51] Int. Cl.[6] ..... C21D 8/00

[52] U.S. Cl. ..... 148/603; 148/602

[58] Field of Search ..... 148/602, 603

[56] References Cited

U.S. PATENT DOCUMENTS 4,504,326 3/1985 Tokunaga ..... 148/603

*Primary Examiner*—Deborah Yee

*Attorney, Agent, or Firm*—Dvorak and Traub

[57] ABSTRACT

A method of manufacturing a cold rolled steel sheet includes the steps of preparing, as a material, a steel whose composition consists of C: 0.004 wt % or less, Si: 0.10 wt % or less, Mn: 0.50 wt % or less, Ti: between 0.01 wt % and 0.10 wt %, Nb: between 0.003 wt % and 0.03 wt %, B: between 0.001 wt % and 0.004 wt %, Al: between 0.03 wt % and 0.10 wt %, P: 0.025 wt % or less, S: 0.01 wt % or less, N: 0.006 wt % or less; performing a hot rolling on the material steel under the conditions of a finishing temperature between 800° C. and 900° C.; coiling the material at a temperature lower than 650° C.; performing a cold rolling; performing a continuous annealing at a temperature between 830° C. and $Ac_3$ transformation point; and performing a skin pass rolling.

3 Claims, 4 Drawing Sheets

METHOD OF MANUFACTURING A LOW-ALLOY ULTRA-LOW-CARBON COLD ANISOTROPY ROLLED STEEL SHEET EXHIBITING AN EXCELLENT RESISTANCE TO FABRICATION EMBRITTLEMENT AND SMALL INTERNAL ANISOTROPY

This is application is a continuation-in-part of application Ser. No. 08/164,612 filed Dec. 8, 1993, which is a Continuation application of Ser. No. 07/966,871, filed Oct. 26, 1992" both now abandoned.

BACKGROUND OF THE INVENTION

1. Field of the Invention

The present invention relates to a method of manufacturing low alloy and ultra-low-carbon a cold rolled steel sheet that exhibits excellent resistance to cold-work embrittlement and a small planar anisotropy by the continuous annealing method which is suitable as a pressed steel sheet for use in automobiles.

2. Description of the Related Art

When a cold rolled steel sheet is manufactured, a continuous annealing, including heating and cooling which last for a short period of time, is generally conducted subsequent to the cold rolling. In this continuous annealing process, the material quality of the product is greatly affected by the chemical composition of the material. Hence, to obtain a steel sheet exhibiting excellent deep drawing property and stretchability, it has been the practice to add a carbide/nitride producing component, such as Ti or Nb, to the extra low carbon steel.

However, the steel sheet in which Ti or Nb is present is characterized in that Ti is readily combined with C, S, N or O in the steel to form a precipitate. Consequently, the grain boundary is cleaned and the grain boundary strength is thus greatly reduced, increasing the possibility that a brittle fracture (the fracture due to cold-work embrittlement) will occur after deep drawing. Also, it has been a practice to obtain a high-strength steel sheet by adding Mn, Si or P to the steel material. In that case, however, since Si and P readily embrittle the steel sheet, the resistance to cold-work embrittlement greatly deteriorates. To improve such a drawback, B has been added to the steel in the form of a solid solution to increase the grain boundary strength, like C.

However, it is well known that adding B deteriorates the formability. Therefore, the proportion of B to be added is restricted to such a small value that sufficient resistance to cold-work embrittlement cannot be obtained.

Various other methods of improving the deep drawing property and stretchability of the steel sheet by controlling the conditions of hot rolling, cold rolling or annealing during the manufacturing process of the steel sheet have also been suggested. Generally, the hot rolling finishing temperature is set to an $Ar_3$ transformation point or above from the viewpoint of improving the deep drawing property. The coiling temperature is between 650° and 800° C. from the viewpoint of improving the formability, especially deep drawing properties. The annealing temperature is set to a relatively low temperature which is equal to or higher than the recrystallization temperature and which is effective in terms of the energy.

Japanese Patent Laid-Open No. 62-278232 discloses a method of manufacturing a cold rolled steel sheet of the aforementioned type for use in non-aging deep drawing by the direct hot-rolling method. Japanese Patent Laid-Open No. 1-177321 discloses a method of manufacturing a cold rolled steel sheet of the aforementioned type which exhibits an excellent deep drawing property. Japanese Patent Laid-Open No. 2-200730 discloses a method of manufacturing a cold rolled steel sheet of the aforementioned type which exhibits an excellent press formability. In any of these methods, although B is added to improve the resistance to cold-work embrittlement, there is no concrete disclosure to exhibit brittle transition temperature. Also, coiling is performed at a high temperature of 640° C. or above which impairs descaling ability in a pickling process. Therefore, in any of these methods, a sufficient improvement in the resistance to cold-work embrittlement cannot be expected.

Japanese Patent Laid-Open No. 63-241122 discloses a method of manufacturing a continuously galvanized steel sheet for use in a super deep drawing. In this method, the proportion of B contained is 0.0010% or below, which is too small to improve the resistance to cold-work embrittlement.

Japanese Patent Laid-Open No. 62-40318 discloses a method of manufacturing a cold rolled steel sheet exhibiting an excellent deep drawing property. Japanese Patent Laid-Open No. 1-188630 discloses a method of manufacturing a cold rolled steel sheet exhibiting an excellent press formability. However, in any of these methods, there is no concrete description of the resistance to cold-work embrittlement, and annealing is conducted at a temperature ranging between the recrystallization temperature and 800° C. Therefore, a sufficient improvement of the resistance to cold-work embrittlement cannot be expected.

Japanese Patent Laid-Open No. 61-133323 discloses a method of manufacturing a steel sheet exhibiting an excellent formability. Japanese Patent Laid-Open No. 62-205231 discloses a method of manufacturing a high-strength steel sheet. Both of these methods are directed to the manufacture of a slab thinner than a normal one and to alleviation or simplification of the rolling process of steel sheet using such a thin slab. However, in the former method, there is no concrete description on the conditions of the annealing which is conducted subsequent to the cold rolling process. Although there is a concrete disclosure of the resistance to cold-work embrittlement, the effect thereof is insufficient. In the latter method, there is a concrete disclosure of the annealing which is conducted at a temperature of 775° C. or below. However, sufficient improvement in the resistance to cold-work embrittlement cannot be expected under such conditions.

In any of the aforementioned conventional methods, it is thus difficult to readily obtain a cold rolled steel sheet exhibiting an excellent deep drawing property and an excellent resistance to cold-work embrittlement.

Planar anisotropy, known as one of barometers of the press formability, is generally evaluated by $\Delta r$. The closer to zero the planar anisotropy value is, the more uniform characteristics in each direction can be obtained, which is desirable in terms of press formability. Japanese Patent Laid-Open No. 61-64852 discloses a method of improving this planar anisotropy by adding a relative large amount of Nb in an extra low carbon steel. Although this method is effective in improving the planer anisotropy, it deteriorates elongation (El) or r value. No method of improving the resistance to cold-work embrittlement as well as the planar anisotropy has been disclosed.

It is disclosed in "Iron and Steel, '73-S191, KUBODERA, NIHON KOKAN (vol. 59, No. 4, Mar. 1973)" that softening and a increase in $\bar{r}$value can be achieved by high-temperature coiling in the hot rolling step (lines 16 and 17), FIG. 1 shows a relation between the coiling temperature (° C.) and the $\bar{r}$value.

It is disclosed in "Iron and Steel, '85-S1361, SAYANAGI, SHIN NIHON STEEL (Vol. 71, No. 13, Sep. 1985)" that as the hot rolling heating temperature decreases, and the coiling temperature increases, the workability improves, and the recrystallization temperature decreases (lines 2 to 3).

In this way, conventionally, the $\bar{r}$ value and elongation are normally increased by decreasing the hot rolling heating temperature, and increasing the coiling temperature. The concept disclosed in U.S. Pat. No. 4,504,326, Tokunaga, utilizes However, the present invention employs the reverse of the conventional method in which the $\bar{r}$ value and elongation are increased by increasing the hot rolling heating temperature and decreasing the coiling temperature.

SUMMARY OF THE INVENTION

It is an object of the present invention to provide a method of manufacturing a cold rolled steel sheet for use in deep drawing which exhibits an excellent resistance to cold-work embrittlement and a small planar anisotropy while maintaining an excellent deep drawing property without the need for finely controlling the manufacturing conditions even when a continuous annealing process is employed.

The present inventors have made intensive studies on the composition to be added and the manufacturing method and discovered that it is possible to manufacture a cold rolled steel sheet for use in deep drawing which exhibits an excellent resistance to cold-work embrittlement and a small planar anisotropy from an extra low carbon steel in which Ti, Nb, B and Al are present each in an adequate amount by adequately setting the hot rolling and annealing conditions in the manufacturing process.

That is, the present invention provides a method of manufacturing a cold rolled steel sheet which exhibits an excellent resistance to cold-work embrittlement and a small planar anisotropy which comprises the steps of preparing, as a material, a steel whose composition consists of:

C: 0.004 wt % or less

Si: 0.10 wt % or less

Mn: 0.50 wt % or less

Ti: between 0.01 wt % and 0.10 wt %

Nb: between 0.003 wt % and 0.03 wt %

B: between 0.001 wt % and 0.004 wt %

Al: between 0.03 wt % and 0.10 wt %

P: 0.025 wt % or less

S: 0.01 wt % or less

N: 0.006 wt % or less

Ti and C satisfying the following equation:

$$3 \leqq Ti^*/C \leqq 12$$

where $Ti^*=Ti-(48/14)N-(48/32)S$ balance: iron and unavoidable impurities, performing a hot rolling on the material steel under the conditions of a finish temperature between 800° C. and 900° C., coiling the material at a temperature lower than 650° C., performing a cold rolling, performing a continuous annealing at a temperature between 830° C. and an $Ac_3$ transformation point, and performing skin pass rolling.

Other features and variations of the present invention will be apparent from the following description taken in connection with the accompanying drawings.

BRIEF DESCRIPTION OF THE DRAWINGS

FIG. 1(*b*) is a graph showing the coiling temperature and the planar anisotropy ($\Delta r$);

FIG. 2(*b*) is a graph showing the relation between the annealing temperature and the planar anisotropy ($\Delta r$)

DETAILED DESCRIPTION OF THE PREFERRED EMBODIMENT

Figure 1:
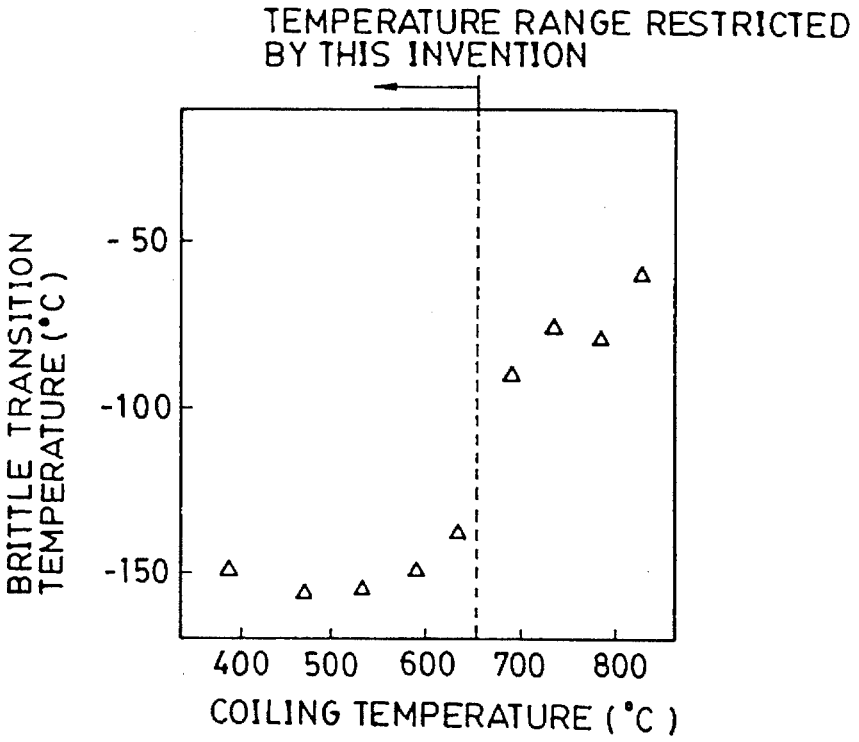
FIG. 1(*a*) is a graph showing the relationship between the coiling temperature and the brittle transition temperature.
Figure 1:
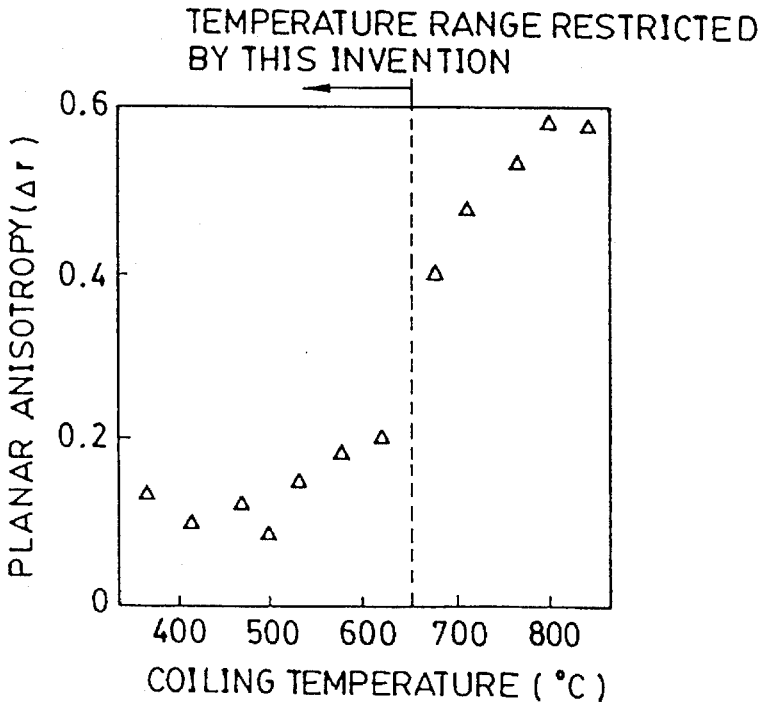

The present invention will be described below concretely.

First, the reason for the restrictions placed on the compositions will be explained.

C: less than 0.0025 wt %

A lower C content is advantageous with respect to the quality of the material. An increase in the C content inevitably increase the amount if Ti required for fixing C, and increases the amount of the composite precipitates produced, thereby Deteriorating the material quality. Recent advances in the technique of iron manufacture enable the C content to be stably maintained at a level of less than 0.0025 wt %. Thus, the upper limit if the C content is set to less than 0.0025 wt %.

Si: 0.10 wt % or less

Although the presence of Si is advantageous to obtain adequate steel strength, it promotes the cold-work embrittlement and degrades the phosphatability. Thus, the upper limit of the proportion of Si is set to 0.10 Wt %.

Mn: 0.50 wt % or less

Although the inclusion of Mn is effective to obtain an adequate strength of the steel, as in the case of Si, it increases the tendency for a solid solution to be produced and hence deteriorates the drawing property. The presence of Mn also increases the production cost. Hence, the upper limit of the proportion of Mn is set to 0.50 wt %.

Ti: 0.01 to 0.1 wt %

$$3 \leqq Ti^*/C \leqq 12$$

where $Ti^* = Ti-(48/14)N-(48/32)S$

The presence of Ti promotes precipitation of N and S and hence improves the deep drawing property. That is, in a cold rolled steel sheet on which the continuous annealing has been conducted, a reduction in the amounts of C, N and S contained alone is not enough to provide the press formability which is as good as that of a steel sheet which has been subjected to the box annealing process. In this invention, Ti promotes precipitation of N and S in the hot rolling process. Precipitation of C is promoted by a combination of Ti and Nb which will be described below. Precipitation of N by Ti enables B to be present in a solid solution which is effective to improve the resistance to cold-work embrittlement.

To stabilize C, N and S, at least 0.01 wt % of Ti must be added. More than 0.1 wt % of Ti does not increase the effect thereof.

Furthermore, it is necessary for Ti and C to be added in a range which satisfies the following equation (1):

$$3 \leqq Ti^*/C \leqq 12$$

where $Ti^* = Ti-(48/14)N-(48/32)S$.

The amount of Ti obtained by the above equation is the effective amount of Ti other than the amount which is consumed as nitride or sulfide. When $Ti^*/C<3$, if coiling is performed at a low temperature of 650° C. or less during the hot rolling process, as in the case of the present invention, part of C remains in the form of a solid solution, deteriorating the deep drawing property. When $Ti^*/C>12$, although the deep drawing property does not deteriorate, the phosphatability deteriorates. As a result, $3S\ Ti^*/C \leqq 12$.

Nb: 0.003 to 0.03 wt %

The presence of Nb, which is a carbide forming component, improves the deep drawing property. The addition of Nb together with Ti increases the average r value and elongation. At least 0.003 wt % is required to obtain the effect of Nb. However, more than 0.03 wt % of Nb reduces the elongation. Thus, the desired proportion of Nb is between 0.003 wt % and 0.03 wt %.

B: 0.001 to 0.004 wt %

As mentioned above, the addition of B intensifies the grain boundary, like C, and hence improves the resistance to cold-work embrittlement. However, an excessive proportion of B increases the tendency for the average r value and elongation to deteriorate, and thus is not desirable in terms of the steel sheet for use in deep drawing. A preferred proportion of B is between 0.001 wt % and 0.004 wt %.

Al: 0.03 to 0.1 wt %

Al is a nitride forming component. The addition of Al together with Ti and Nb forms composite precipitates which are inferred as (Ti, Nb)C and (Ti, Al)N and hence promotes precipitation of C and N. It also improves the formability, particularly, the deep drawing property and reduces the planar anisotropy. At least 0.03 wt % of Al is necessary for the above-mentioned effects. More than 0.1 wt % of Al does not improve the effect of Al and increases the production cost. Therefore, a desired proportion of Al is between 0.03 wt % and 0.1 wt %.

P: 0.025 wt % or less

An excessive proportion of P increases the amount of grain boundary which is segregated and hence promotes the grain boundary embrittlement, and thus, deteriorates the resistance to cold-work embrittlement. Hence, the smaller the proportion of P, the better. 0.025 wt % or less of P is allowable.

S: 0.01 wt % or less

An excessive proportion of S, which is a hazardous component, readily promotes the grain boundary embrittlement and thus deteriorates the resistance to cold-work embrittlement. Thus, a smaller possible proportion of S is desired. 0.01 wt % or less of S is allowable.

N: 0.006 wt % or less

Like C, a smaller possible proportion of N is desirable from the viewpoint of improvement in the formability, particularly, deep drawing properties. The presence of N also deteriorates the resistance to strain aging. Thus, up to 0.006 wt % of N is allowable, O :0.003 wt % or less Although O is mainly removed by Al, the effects of the O content in the steel on the material quality have hardly been examined. The examination performed in the present invention reveals that the elongation is improved by decreasing the O content in the steel, and the elongation is significantly improved by decreasing the O content to 0.003 wt. % or less. Thus, the upper limit of O is set to 0.003 wt %.

The relation between the oxygen content and elongation was examined by the following experiment:

The samples used in the experiment were produced by using as a material a billet containing 0.002 wt % of C, 0.01 wt % of Si, 0.15 wt % of Mn. 0.030 wt % of ti, 0.008 wt % of Nb, 0.0020 wt % of B, 0.006 wt % of Al, 0.01 wt % of P, 0.005 wt % of S, 0.003 wt % of N, and 0.008 to 0.011 wt % of O under the following conditions:

Slab reheating temperature: 1250° C.

Hot rolling finishing temperature: 890° C.

Coiling temperature: 540° C.

Cold rolling reduction: 1.2 mm

Annealing temperature: 870° C.×40 sec.

Skin pass reduction: 1%

Figure 4:
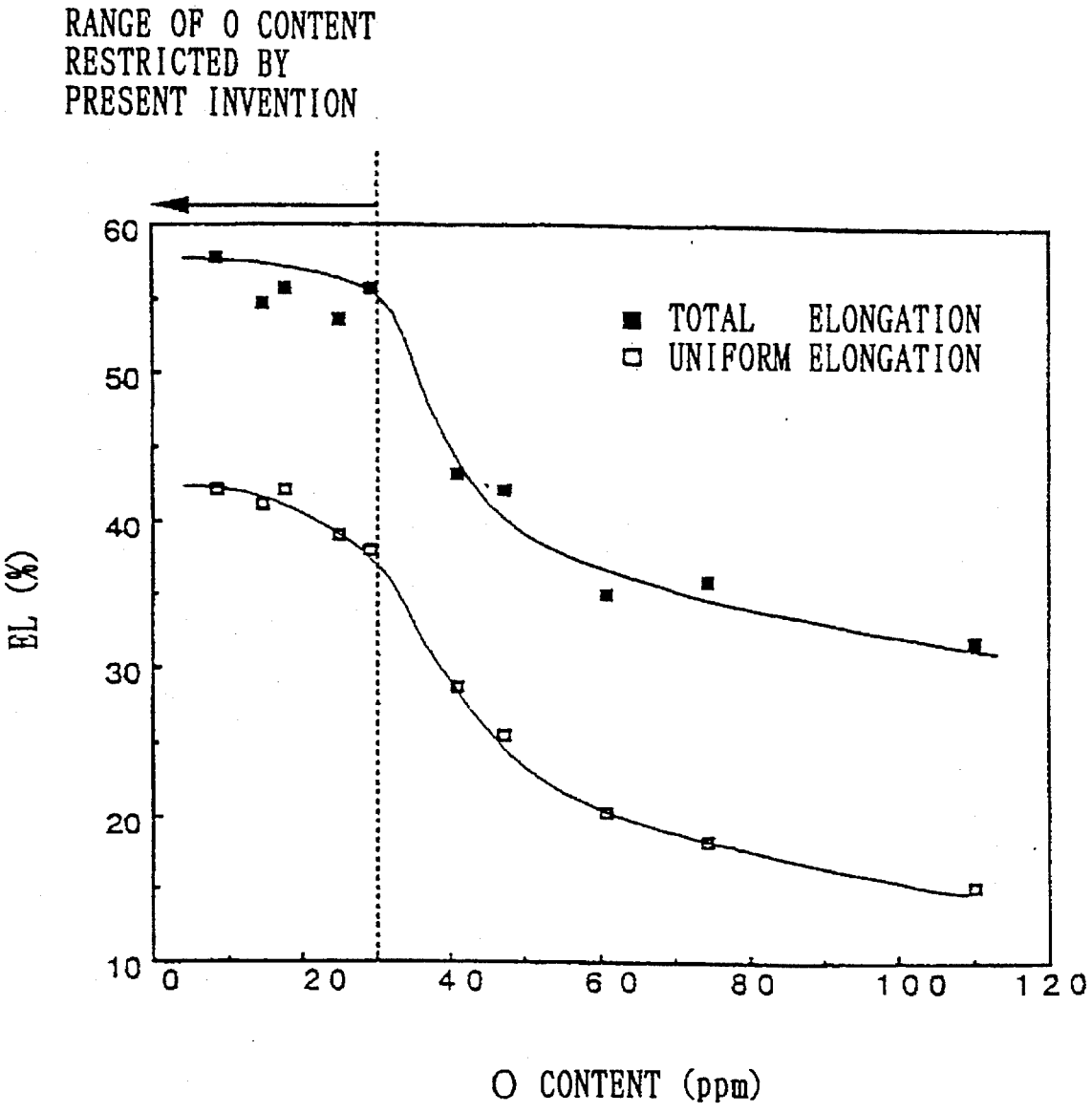
FIG. 4 is a graph showing the relation between the oxygen content in the steel and the total elongation and uniform elongation.

JIS No. 5 specimens were obtained from the above samples, and the total elongation and uniform elongation of the specimens were measured. The results of measurement are shown in FIG. 4. As is obvious from FIG. 4, when the O is 0.003 wt % or less, the total elongation and uniform elongation are increased. It was newly found that the elongation, particularly, the uniform elongation, is improved by decreasing the O content. The uniform elongation represents the elongation produced in the time the start of pulling to the application of the highest load in a tensile test.

The reason for the restrictions placed on the manufacturing process conditions in the present invention will be described below.

Steel making process

Steel may be manufactured in a normal method which employs, for example, a converter. There is no restriction on the conditions of the steel making process.

Steel may be manufactured in a normally employed continuous casting or ingot casting method.

Hot rolled process.

Slab reheating temperature: 1200° C. or more

Although the temperature is increased to a temperature required for the subsequent hot rolling, the quality of the material after the hot rolling is maintained by heating, if the temperature is excessively low, the uniformity of temperature of the whole coil after hot rolling deteriorates. Particularly, since a temperature in the edge portion of the coil in the widthwise direction thereof is decreased, a large temperature difference is produced between the central portion and the edge portion, and thus nonuniformity easily occurs in the material of the whole coil during operation. It is thus preferred that the slab reheating temperature is 1200° or more. The slab reheating temperature is also preferably 1300° C. or less from the viewpoint of the problem such as the remaining scales produced when the heating temperature is to high.

Finishing temperature: 800° to 900° C.

A finishing temperature lower than 800° C. deteriorates the average r value and the elongation due to residual strain. A finishing temperature higher than 900° C. increases the size of the grains and hence deteriorates the average r value. Thus, a desired finishing temperature range is from 800° C. and 900° C.

Coiling temperature: lower than 650° C.

Conventionally, a high coiling temperature ranging from 650° C. to 800° C. has been employed because it has been considered that coiling conducted at such a high temperature further increases the size of the TiC precipitates and thus improves the elongation and average r value. It has also been considered that nuclei of TiC and (Ti, Al)N are not readily generated and the precipitation speed is thus slowed down or precipitation is made incomplete in the coiling conducted at a low temperature, making precipitation of C and N insufficient and deteriorating the elongation and average r value.

The present inventors made various experiments in which different coiling temperatures were employed, and discovered that coiling conducted at a low temperature provided a steel sheet which exhibited an excellent resistance to cold-work embrittlement and a small planar anisotropy.

The results of the experiments are shown in FIG. 1(*a*) which is a graph showing the relation between the coiling temperature and the brittle transition temperature which is the index of the cold-work embrittlement. FIG. 1(*b*) is a graph showing the relation between the coiling temperature and the planar anisotropy Δr. As shown in these figures, a reduction in the annealing temperature improves the resistance to cold-work embrittlement and reduces the planar anisotropy.

In the steel having the composition restricted by the present invention, it is considered that the planar anisotropy is reduced because precipitation of (Ti, Nb)C and (Ti, Al)N begins in the high-temperature range obtained before the hot rolling is finished and is promoted in the coiling conducted at a low temperature, precipitating C and N to a sufficient extent and reducing the size of the grains which have been subjected to the hot rolling process. It is also considered that the formation of such precipitates promotes segregation of B into the grain boundary, intensifies the grain boundary and thus improves the resistance to cold-work embrittlement.

Thus, the upper limit of the coiling temperature is set to 650° C. from the viewpoint of an improvement in the resistance to cold-work embrittlement and a reduction in the planar anisotropy. Although there is no restriction on the lower limit, a desirable lower limit is set to 300° C. with the cooling ability and cooling time or the coil shape obtained taken into consideration.

The samples used in the aforementioned experiments were manufactured under the following conditions using, as a material, a steel which contained 0.002 wt % of C, 0.01 wt % of Si, 0.15 wt % of Mn, 0.03 wt % of Ti, 0.005 wt % of Nb, 0.002 wt % of B, 0.06 wt % of Al, 0.015 wt % of P, 0.005 wt % of S 0.004 wt % of N and 0.00025 wt % of Slab reheating temperature; 1200° C.

Hot rolling finishing temperature: 890° C.

Coiling temperature: 300 to 850° C.

Cold rolling reduction: 80%

Thickness of a cold rolled sheet: 0.7 mm

Continuous annealing conditions: 860° C. and 20 seconds

Skin pass reduction: 1%

The brittle transition temperature was measured by measuring the highest temperature at which the brittle fracture occurred in each of the conical cup samples each having a blank diameter of 50 mm, a diameter of a dice of 24.4 mm and a punch diameter of 20.64 mm in the crash tests by employing different testing temperatures.

The planar anisotropy dr was calculated by the following equation (2) using the value in the L direction (the direction of rolling) $r_L$, the value in the D direction (the direction which is 45 degrees from the direction of rolling) $r_D$ and the value in the C direction (the direction which is 90 degrees from the direction of rolling) $r_c$ which were measured using the sample to which a tensile strain of 15% was applied beforehand:

$$\Delta r=(r_c+r_L-2r_D)/2 \quad (2)$$

As is clear from FIG. 1(*b*), a desirable range of the planar anisotropy Δr is as follows:

$$0 \leqq \Delta r \leqq 0.245$$

A planar anisotropy dr of more than 0.25 increases the inhomogeneous strain distribution and thus deteriorates the formability.

Continuous annealing temperature 830° C. to $Ac_3$ transformation point

Conventionally, no restriction has been placed on the annealing temperature in the continuous annealing process because it has been considered that the material characteristics are determined by the hot rolling conditions. However, the present inventors have researched and found that the annealing temperature greatly affected cold-work embrittlement (the brittle transition temperature) and the planar anisotropy (Δr), as shown in FIGS. 2(*a*) and 2(*b*).

Figure 2A:
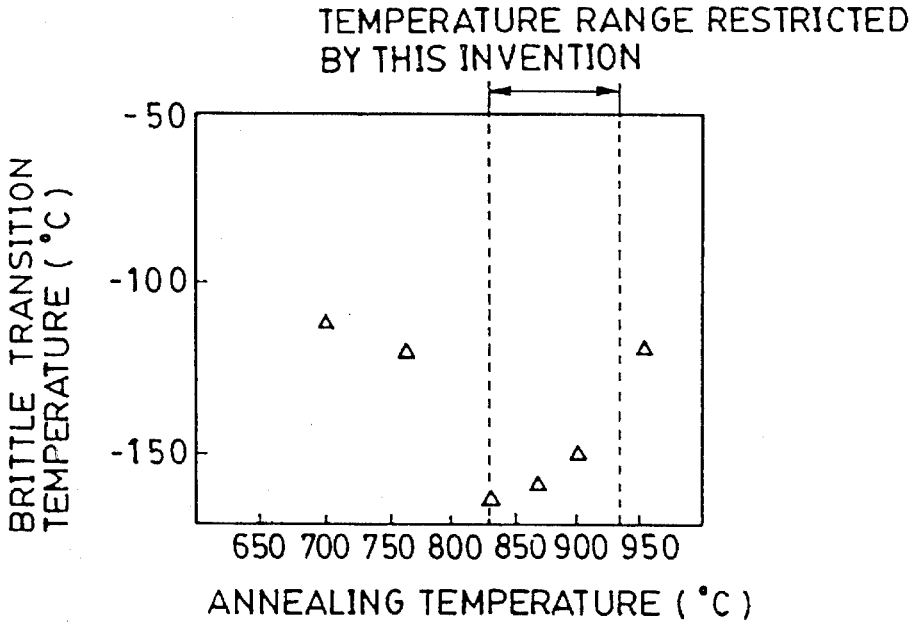
FIG. 2(*a*) is a graph showing the relation between the annealing temperature and the brittle transition temperature.
Figure 2B:
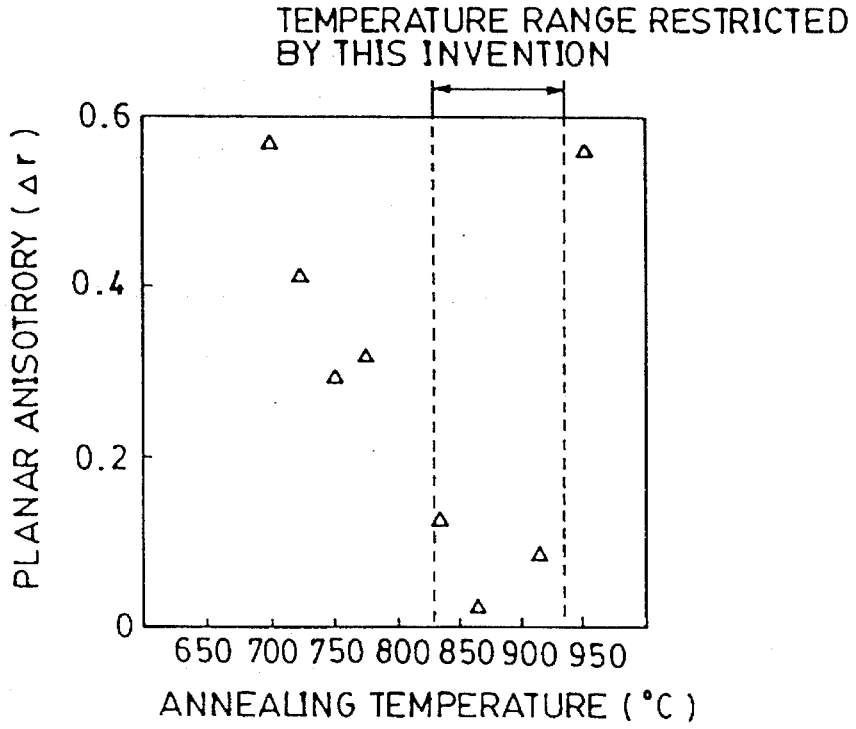

FIG. 2(*a*) shows the relation between the annealing temperature and the brittle transition temperature. FIG. 2(*b*) shows the relation between the annealing temperature and the planar anisotropy (Δr).

It is considered that the resistance to cold-work embrittlement was not improved in the annealing conducted at a temperature less than 830° C. because segregation of B into the grain boundary was insufficient. It is also considered that the planar anisotropy was not reduced in the annealing conducted at a temperature less then 830° C. because the recrystallized grain orientation was affected by the cold-rolled grain orientation.

In an annealing conducted at a temperature higher than the $Ac_3$ transformation point, the size of the grains will increase, deteriorating the resistance to cold-work embrittlement and increasing the planar anisotropy due to the transformation.

Thus, a preferred continuous annealing temperature is from 830° C. and $Ac_3$ transformation point from the viewpoint of improvement in the resistance to cold-work embrittlement and reduction in the planar anisotropy.

The samples employed in the experiments were manufactured under the following conditions using, as a material, a steel which contained 0.002 wt % of C., 0.02 wt % of Si, 0.19 wt % of Mn, 0.025 wt % of Ti, 0.01 wt % of Nb, 0.0025 wt % of B, 0.08 wt % of Al, 0.02 wt % of P, 0.006 wt % of S 0.003 wt % of N and 0.003 wt % of O.

Slab reheating temperature: 1250° C.

Hot rolling finishing temperature: 880° C.

Coiling temperature: 600° C.

Cold rolling reduction: 70%

Thickness of the cold rolled sheet: 1.2 mm

Continuous annealing conditions: 700 to 950° C. and 20 seconds

Skin pass reduction: 1%

The brittle transition temperature and dr were measured in the same manner as the aforementioned one.

Figure 3:
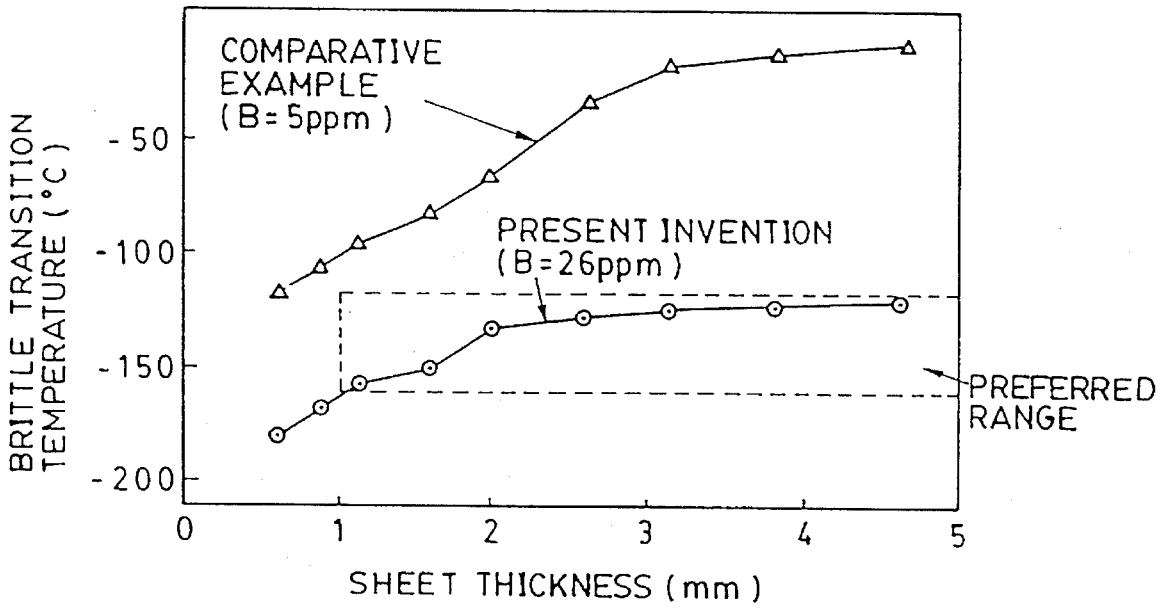
FIG. 3 is a graph showing the relation between the thickness of the steel and the brittle transition temperature regarding steels in which different amounts of B are present.

As stated above, the resistance to cold-work embrittlement is greatly affected by the chemical composition of the material and the hot rolling and continuous annealing temperatures. This resistance to cold-work embrittlement is also affected by the thickness of the steel sheet. In the case of the same material, the thicker the steel sheet, the higher the brittle transition temperature of the resistance to cold-work embrittlement (see FIG. 3). The advantages of the present invention can be most readily obtained when the thickness is 1.0 mm or more at which deterioration in the resistance to cold-work embrittlement most readily occurs. The upper limit of the thickness is set to 5.0 mm because it is difficult to manufacture a cold rolled steel sheet having a thickness of more than 5.0 mm. The samples employed in the experiments were manufactured under the following conditions using, as a material, a steel which contained 0.002 wt % of C, 0.01 wt % of Si, 0.15 wt % of Mn, 0.026 wt % of Ti, 0.008 wt % of Nb, 0.0026 wt % (26 ppm) or 0.0005 wt % (5 ppm) of B, 0.07 wt % of Al, 0.021 wt % of P, 0.005 wt % of S 0.002 wt % of N and 0.0025 wt % of O and which had a thickness ranging from 0.6 mm to 3.1 mm.

Slab reheating temperature: 1250° C.

Hot rolling finishing temperature: 880° C.

Coiling temperature: 600° C.

Continuous annealing conditions: 840° C. and 40 seconds

Cold rolling reduction: 65 to 73%

(The brittle transition temperature was measured in the same manner as the aforementioned one.)

Other conditions

Although regarding the cold rolling and skin pass rolling processes, the normally employed conditions can be used, a preferred cold rolling reduction is between 50 and 95% while a preferred skin pass rolling is between 0.5 and 2%.

EXAMPLES

Table 1 shows the chemical composition of each of the slabs manufactured by the continuous casting method from a molten steel manufactured by a normal manufacturing process. After hot rolling was performed on the steels having the compositions shown in Table 1 under the conditions shown in Table 2 to obtain hot rolled sheet coils having a thickness of 3.5 mm, cold rolling was performed to obtain cold rolled sheets having a thickness of 1.2 mm. Thereafter, continuous annealing was conducted at various temperatures shown in Table 2, and then skin pass rolling was performed at a reduction of 1%.

TABLE 1

| | CHEMICAL COMPOSITION (WT %) | | | | | | | | | | | | |
|---|---|---|---|---|---|---|---|---|---|---|---|---|---|
| SYMBOL | C | Si | Mn | P | S | Al | O | N | Ti | Nb | B | Ti*/C | REMARKS |
| A | 0.0020 | 0.01 | 0.17 | 0.012 | 0.004 | 0.053 | 0.0020 | 0.0025 | 0.028 | 0.005 | 0.0015 | 5.37 | SUITABLE |
| B | 0.0016 | 0.02 | 0.13 | 0.011 | 0.004 | 0.071 | 0.0015 | 0.0021 | 0.031 | 0.004 | 0.0025 | 11.13 | EXAMPLE |
| C | 0.0018 | 0.01 | 0.09 | 0.009 | 0.003 | 0.058 | 0.0018 | 0.0022 | 0.025 | 0.009 | 0.0018 | 7.20 | |
| D | 0.0021 | 0.01 | 0.12 | 0.009 | 0.004 | 0.065 | 0.0024 | 0.0018 | 0.028 | 0.005 | 0.0022 | 7.54 | |
| E | 0.0021 | 0.01 | 0.11 | 0.011 | 0.004 | 0.049 | 0.0021 | 0.0025 | 0.032 | 0.008 | 0.0020 | 7.26 | |
| F | 0.0040 | 0.01 | 0.12 | 0.011 | 0.006 | 0.061 | 0.0028 | 0.0033 | 0.005 | 0.006 | 0 | −5.28 | COMPARATIVE |
| G | 0.0022 | 0.02 | 0.10 | 0.011 | 0.006 | 0.071 | 0.0045 | 0.0021 | 0 | 0.009 | 0.0027 | −7.36 | EXAMPLE |
| H | 0.0035 | 0.02 | 0.11 | 0.012 | 0.006 | 0.053 | 0.0024 | 0.0025 | 0.035 | 0 | 0.0005 | 9.17 | |
| I | 0.0024 | 0.01 | 0.16 | 0.013 | 0.005 | 0.057 | 0.0021 | 0.0019 | 0.012 | 0.005 | 0.0016 | −0.84 | |
| J | 0.0050 | 0.02 | 0.15 | 0.010 | 0.005 | 0.056 | 0.0058 | 0.0020 | 0.041 | 0.004 | 0.0001 | 12.69 | |

Underlined figure is out of the range restricted by the present invention.

TABLE 2

| | Symbol | Material Characteristics | | | | | | Hot Rolling Conditions | | | Annealing | |
|---|---|---|---|---|---|---|---|---|---|---|---|---|
| Sample No. | of Steel | YS kgf/mm² | TS kgf/mm² | EI (%) | Average r Value | Δr | Tcr *1 (°C.) | SRT *2 (°C.) | FDT *3 (°C.) | CT *4 (°C.) | Temperature °C. | Remarks |
| 1 | A | 16.8 | 30.5 | 56 | 2.2 | 0.18 | −160 | 1250 | 880 | 540 | 850 | Suitable |
| 2 | B | 17.3 | 31.0 | 55 | 2.3 | 0.21 | −150 | 1240 | 890 | 580 | 850 | Example |
| 3 | C | 15.2 | 29.8 | 56 | 2.4 | 0.25 | −140 | 1250 | 885 | 610 | 870 | |
| 4 | D | 15.9 | 30.1 | 57 | 2.4 | 0.17 | −155 | 1200 | 890 | 510 | 880 | |
| 5 | E | 15.8 | 31.5 | 56 | 2.5 | 0.14 | −150 | 1250 | 880 | 600 | 875 | Comparative |
| 6 | F | 20.3 | 34.7 | 43 | 1.6 | 1.03 | −55 | 1200 | 885 | 540 | 860 | Example |
| 7 | G | 19.6 | 33.5 | 44 | 1.7 | 0.85 | −100 | 1200 | 870 | 535 | 860 | |
| 8 | H | 20.1 | 33.9 | 44 | 1.6 | 0.77 | −75 | 1250 | 870 | 520 | 865 | |
| 9 | I | 18.9 | 33.0 | 42 | 1.8 | 0.58 | −150 | 1200 | 870 | 580 | 875 | |
| 10 | J | 20.1 | 31.0 | 42 | 1.5 | 0.85 | −50 | 1050 | 810 | 680 | 850 | |
| 11 | A | 19.5 | 30.4 | 45 | 1.7 | 0.88 | −100 | 1050 | 820 | 590 | 820 | |
| 12 | B | 20.5 | 31.8 | 44 | 1.6 | 0.76 | −60 | 1100 | 840 | 670 | 850 | |
| 13 | C | 20.1 | 29.9 | 42 | 1.4 | 0.90 | −45 | 1200 | 820 | 700 | 800 | |

Underlined figure is out of the range restricted by this invention.

*1 TCR: Brittle transition temperature

*2 SRT: Slab reheating temperature

*3 FDT: Final finishing temperature

*4 CT: Coiling temperature

The tensile characteristics, the average r value, the planar anisotropy ($\Delta r$) and the cold-work embrittlement (brittle transition temperature) of the thus-obtained cold rolled steel sheets were examined. The results of the examinations are shown in FIG. 2.

The tensile test was conducted in conformity with JIS No. 5. The average r value was calculated from $r_L$, $r_D$ and $r_c$ by the following equation.

$$\text{Average r value} = (r_L + 2r_D + r_c)/4$$

$\Delta r$ and the brittle transition temperature were obtained in the same manner as the aforementioned ones.

As is clear from Table 2, in the examples (sample Nos. 1 through 5) of the present invention, TS≦29.5 Kgf/mm$^2$, El≦50% and the average r value ≦2.0. Also, the brittle transition temperature ≦−140° C. and $\Delta r \leqq 0.25$, that is, substantially no cold-work brittle fracture occurred and the planar anisotropy was very less.

In the comparative examples (sample Nos. 6 through 13) manufactured from the material having the composition restricted by the present invention under the manufacturing conditions which were out of the range restricted by the present invention, the brittle transition temperature was high and the planar anisotropy $\Delta r \leqq 0.58$. In the comparative examples (sample Nos. 6 through 10) manufactured from the material having the composition which was out of range restricted by the present invention under the manufacturing conditions restricted by the present invention, the brittle transition temperature ≦−100° C. , and $\Delta r \leqq 0.58$.

Thus, the cold rolled steel sheets alone which satisfy both the composition and manufacturing conditions restricted by the present invention have excellent characteristics.

The present invention is directed to manufacture of a cold rolled steel sheet for use in deep drawing which exhibits an excellent resistance to cold-work embrittlement and a very small planar anisotropy using, as a material, an extra low carbon steel in which adequate amounts of Ti, Nb, B and Al are present under the appropriate hot rolling and continuous annealing conditions even when the continuous annealing process is used.

The cold rolled steel sheet obtained in this invention is suitable for use in, for example, automobiles, where excellent press formability is required.

What is claimed is:

1. A method of manufacturing a low-alloy and ultra-low-carbon cold rolled steel sheet exhibiting an excellent resistance to fabrication embrittlement and small internal anisotropy, comprising the steps of;

Preparing, as a material, a billet having the following composition:

C: less than 0.0025 wt %,
Si: 0.10 wt % or less,
Mn: 0.50 wt % or less,
Ti: between 0.01 wt % and 0.10 wt %,
Nb: between 0.003 wt % and 0.03 wt %,
B: between 0.001 wt % and 0.004 wt %,
Al: between 0.03 wt % and 0.10 wt %,
P: 0.025 wt % or less,
S: 0.01 wt % or less,
N: 0.006 wt % or less,
O: 0.003 wt % or less, Ti and C satisfying the following equation:

$$3 \leqq Ti^*/C \leqq 12$$

wherein $Ti^* = Ti - 48/14N - 48/32S$, balance: iron and unavoidable impurities;

performing hot rolling on the material billet tinder the conditions of a slab reheating temperature of 1200° C. or more, a finishing temperature between over 870° C. and 900° C.;

coiling the material at a temperature lower than 650°;

performing cold rolling;

performing continuous annealing at a temperature between 830° C. and the $AC_3$ transformation point; and performing skin pass rolling.

2. A method of manufacturing a low-alloy and ultra-low-carbon cold rolled steel sheet exhibiting and excellent resistance to fabrication embrittlement and a small internal anisotropy according to claim 1, wherein the steel sheet has a thickness ranging from 1.0 mm to 5.0 mm.

3. A method of manufacturing a low-alloy and ultra-low-carbon cold rolled steel sheet exhibiting an excellent resistance to fabrication embrittlement and a small internal anisotropy according to claim 1, wherein the internal anisotropy ($\Delta r$) satisfies the following equation:

$$0 \leqq \Delta r \leqq 0.25$$

wherein $\Delta r = (r_c + r_L - 2r_D)/2$ $r_L$: Lankford value in the direction of rolling $r_D$: Lankford value in the direction at 45 degrees with respect to the direction of rolling $r_c$: Lankford value in the direction at 90 degrees with respect to the direction of rolling.

* * * * *